US007069894B2

(12) United States Patent
Gessner et al.

(10) Patent No.: US 7,069,894 B2
(45) Date of Patent: Jul. 4, 2006

(54) INTAKE MANIFOLD HAVING INTAKE PIPES LINKED BY TRANSVERSE ACOUSTIC SYNCHRONIZATION CHANNELS WITH EXHAUST GAS RECIRCULATION INLETS

(75) Inventors: Klaus Gessner, Muehlacker (DE); Ludger Stuerwald, Sindelfingen (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/110,796

(22) Filed: Apr. 21, 2005

(65) Prior Publication Data

US 2005/0235941 A1 Oct. 27, 2005

(30) Foreign Application Priority Data

Apr. 24, 2004 (DE) ..... 10 2004 020 102

(51) Int. Cl.
*F02M 35/10* (2006.01)

(52) U.S. Cl. ..... 123/184.31

(58) Field of Classification Search ..... 123/184.31, 123/184.61, 184.21, 184.35, 568.12, 568.19
See application file for complete search history.

(56) References Cited

U.S. PATENT DOCUMENTS 5,490,488 A * 2/1996 Aversa et al. ..... 123/568.12
5,944,000 A 8/1999 Bieler et al.
6,167,855 B1 1/2001 Mammarella et al.
6,513,507 B1 2/2003 Balekai et al.

FOREIGN PATENT DOCUMENTS

| | | |
|---|---|---|
| DE | 693 00 649 T2 | 4/1996 |
| DE | 298 11 432 U1 | 10/1998 |
| DE | 696 01 239 T2 | 5/1999 |
| EP | 0 456 957 B1 | 11/1991 |
| EP | 565 410 B1 | 3/1993 |
| EP | 736 684 B1 | 4/1996 |
| EP | 1 074 732 A2 | 2/2001 |

OTHER PUBLICATIONS

International Search Report dated Aug. 17, 2005, (four (4) pages) including English translation of relevant portion.

* cited by examiner

*Primary Examiner*—Henry C. Yuen
*Assistant Examiner*—Hyder Ali
(74) *Attorney, Agent, or Firm*—Crowell & Moring LLP

(57) ABSTRACT

An intake manifold arrangement for an internal combustion engine in which transverse channels (12) are arranged between the intake channels upstream from the cylinder intakes of a multi-cylinder internal combustion engine equipped with exhaust gas recirculation. The connections (2, 3) for the introduction of clean air into the intake channels, the transverse channels (12) and a connecting flange (4) for the exhaust gas recirculation line are integrated into a one-piece component (1), preferably made of cast aluminum, which can be mounted on the respective cylinder intakes of the internal combustion engine, particularly a V engine.

4 Claims, 1 Drawing Sheet

INTAKE MANIFOLD HAVING INTAKE PIPES LINKED BY TRANSVERSE ACOUSTIC SYNCHRONIZATION CHANNELS WITH EXHAUST GAS RECIRCULATION INLETS

BACKGROUND OF THE INVENTION

The present invention relates to an intake manifold arrangement for an internal combustion engine in which so-called transverse channels or feedthroughs between the intake channels are provided upstream from the cylinder intakes of a multicylinder internal combustion engine.

Published German Utility Model No. DE 298 11 432 U1 discloses an intake manifold system for an internal combustion engine in which neighboring intake channels have such cross connections between the intake channels, in particular to improve the acoustic properties.

In addition, it is customary for most of today's motor vehicle internal combustion engines to also be equipped with exhaust gas recirculation, both because this is advisable for technical reasons and also to comply with strict regulations on emissions. For example, today's gasoline and diesel engines with direct fuel injection are usually already equipped with such exhaust gas recirculation.

It is known from U.S. Pat. No. 5,944,000 (=DE19717040), for example, that the exhaust gas recirculation line is connected via a metal sleeve to the cylinder head flange of the internal combustion engine.

However, a combination of these essentially known configurations is problematic from a structural standpoint because it requires multiple components having a large number of sealing surfaces on the respective connecting flanges. Furthermore, the heat input and an optimum distribution of exhaust gas recirculation necessitate relatively complex and expensive measures that also require intensive, and consequently expensive, machining.

SUMMARY OF THE INVENTION

Accordingly, it is an object of the present invention to provide an improved intake manifold for an internal combustion engine with transverse channels between intake channels and with exhaust gas recirculation.

Another object of the invention is to provide an intake manifold with transverse channels between intake channels and with exhaust gas recirculation which reduces the number of parts and the number of sealing surfaces required compared to prior designs.

A further object of the invention is to provide an intake manifold with transverse channels between intake channels and with exhaust gas recirculation which improves heat transfer and distribution of recirculated exhaust gas.

These and other objects are achieved in accordance with the present invention by providing an intake manifold arrangement for a multi-cylinder internal combustion engine comprising a plurality of intake channels leading to a plurality of cylinder intakes, further comprising at least one transverse channel arranged between adjacent intake channels upstream from the cylinder intakes of the internal combustion engine and an exhaust gas recirculation inlet, wherein connections for introducing clean air into the intake channels, the transverse channels and a connecting flange for an exhaust gas recirculation line are integrated into a one-piece component which can be mounted on the respective cylinder intakes of the internal combustion engine.

The intake manifold arrangement according to the present invention for an internal combustion engine of the type described above in which transverse channels are provided between the intake channels upstream from the cylinder intakes of a multi-cylinder internal combustion engine and an exhaust gas recirculation is improved upon in an advantageous manner by the fact that connections for introduction of clean air into the intake channels, the transverse channels and a connecting flange for the exhaust gas recirculation line are integrated into a one-piece component which can be mounted on the respective cylinder intakes of the internal combustion engine.

According to one advantageous embodiment of an intake manifold arrangement constructed in accordance with the invention, the connecting flange for the exhaust gas recirculation line is arranged on the one-piece component in the area of the center of the respective transverse channel, and the supply of recirculated exhaust gas through corresponding openings in the intake channels is provided at separate preselectable introduction points.

The one-piece component is preferably a cast part, in particular a cast aluminum part.

In summary, advantages are achieved with the inventive intake manifold arrangement with regard to the reduction in the number of essential components and in particular with regard to the reduction in the number of sealing surfaces, so that the arrangement is less complex and can be manufactured with smaller tolerances.

The relatively high temperatures of the recirculated exhaust gas can be reduced more rapidly due to the thermal coupling of all the individual elements in the one-piece component which has a relatively large volume, especially when it is a cast aluminum part. Furthermore, the introduction point in the respective intake channel can be defined easily in the design as an air conduction pipe. Thus, a positive definition of the respective mixing zone with the clean air is made possible in a simple manner, and a uniform distribution of the air introduced can be easily achieved.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figure 1:
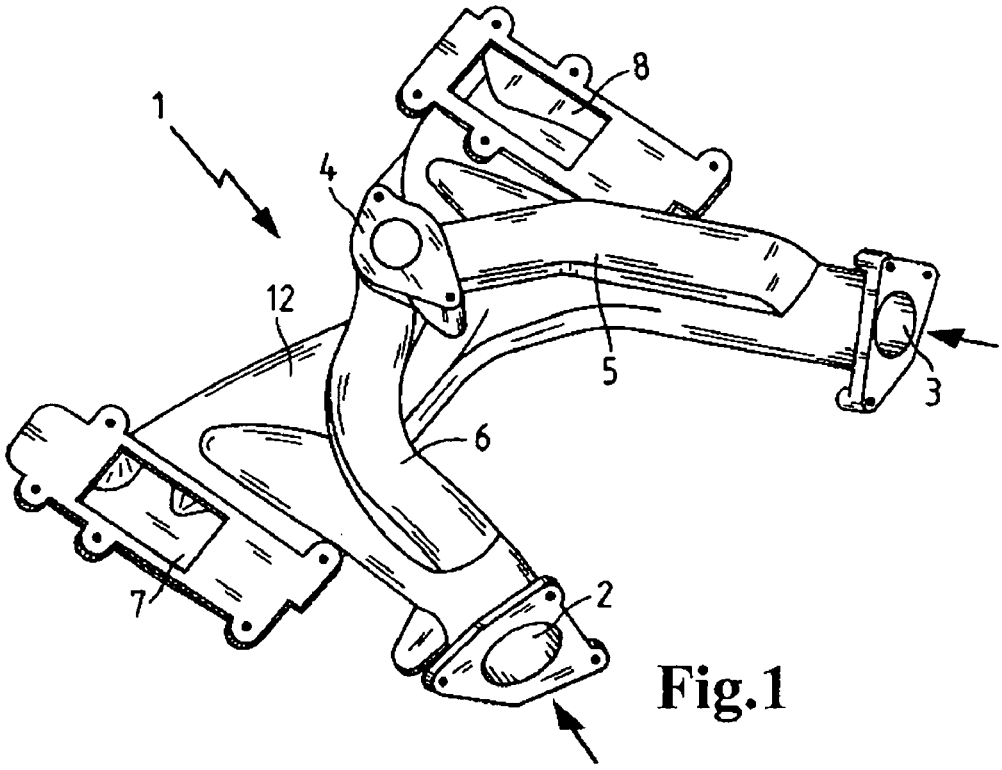
FIG. 1 is a schematic view of a one-piece component of a transverse channel having an exhaust gas recirculation inlet.

FIG. 1 shows a view of a component 1 of an intake manifold arrangement having a so-called transverse channel 12 and a component of the intake system of an internal combustion engine (not shown here), in particular a V engine. Clean air for combustion is drawn in through the connecting flanges 2 and 3, and exhaust gas is recirculated (EGR) through a connecting flange 4, the exhaust gas being sent through the channels 5 and 6, which are integrated into the component 1, and added to the clean air at introduction points (not shown here) within the component 1.

Figure 2:
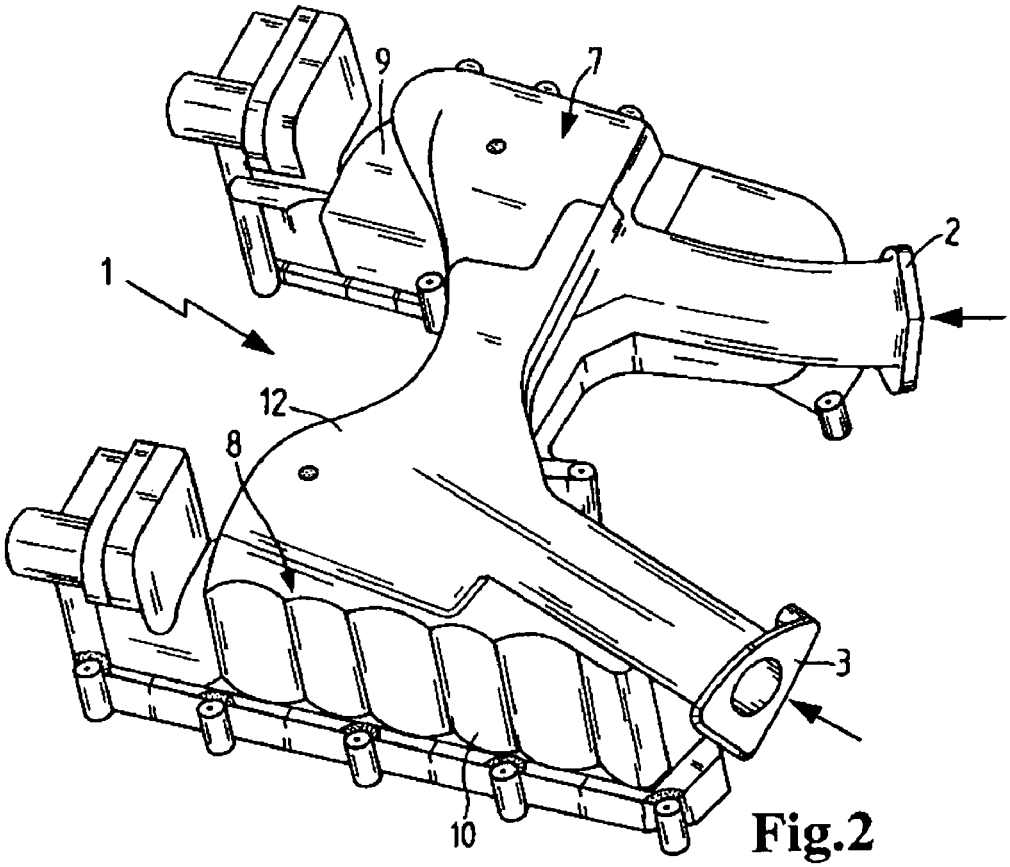
FIG. 2 is a perspective view of the component of FIG. 1 showing how the intake manifold is mounted on an internal combustion engine.

In the illustrated embodiment, the component 1 is mounted on the cylinder head of a V-engine by additional connecting flanges 7 and 8 which are joined via the transverse channel 12. FIG. 2 shows schematically the corresponding connecting parts 9 and 10 of such a V engine, where the component 1 here is viewed from the reverse direction in comparison with the view of FIG. 1.

The large-volume one-piece component 1, for example, a cast aluminum part, thus ensures excellent thermal coupling of the connecting flange 4 of the exhaust gas recirculation to the transverse channel 12 for more rapid cooling and also permits a simple definition of the respective mixing zone with the clean air. The arrangement according to the invention can be used with all internal combustion engines in which exhaust gas recirculation (EGR) is not integrated into the cylinder head.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An intake manifold arrangement for a multi-cylinder internal combustion engine comprising a plurality of intake channels leading to a plurality of cylinder intakes, further comprising at least one transverse channel arranged between adjacent intake channels upstream from the cylinder intakes of the internal combustion engine and an exhaust gas recirculation inlet, wherein connections for introducing clean air into the intake channels, at least one transverse channel and a connecting flange for an exhaust gas recirculation line are integrated into a one-piece component which can be mounted on the respective cylinder intakes of the internal combustion engine; the connecting flange for the exhaust gas recirculation line is arranged in the area of the center of the respective transverse channel, and openings into the intake channels for supplying recirculated exhaust gas are situated at pre-selected introduction points.

2. An intake manifold arrangement according to claim 1, wherein the one-piece component is a cast metal part.

3. An intake manifold arrangement according to claim 2, wherein the cast part is made of aluminum.

4. An intake manifold arrangement according to claim 1, wherein the manifold in configured to fit a V-type internal combustion engine, and the recirculated exhaust gas is introduced into the intake channels at a point spaced a distance from the engine cylinder head.

* * * * *